US011473245B2

(12) United States Patent
Marcoccia et al.

(10) Patent No.: US 11,473,245 B2
(45) Date of Patent: Oct. 18, 2022

(54) SURFACE ENHANCED PULP FIBERS AT A SUBSTRATE SURFACE

(71) Applicant: DOMTAR PAPER COMPANY, LLC, Fort Mill, SC (US)

(72) Inventors: Bruno Marcoccia, Charlotte, NC (US); Harshad Pande, Pointe-Claire (CA); Jacob P. John, Saint Claire, MI (US); Robert Mason Williams, Woodsfield, OH (US)

(73) Assignee: Domtar Paper Company LLC, Fort Mill, SC (US)

( * ) Notice: Subject to any disclaimer, the term of this patent is extended or adjusted under 35 U.S.C. 154(b) by 303 days.

(21) Appl. No.: 16/322,522

(22) PCT Filed: Aug. 1, 2017

(86) PCT No.: PCT/US2017/044881

§ 371 (c)(1),
(2) Date: Feb. 1, 2019

(87) PCT Pub. No.: WO2018/026804

PCT Pub. Date: Feb. 8, 2018

(65) Prior Publication Data

US 2020/0325629 A1 Oct. 15, 2020

Related U.S. Application Data

(60) Provisional application No. 62/374,341, filed on Aug. 12, 2016, provisional application No. 62/369,362, filed on Aug. 1, 2016.

(51) Int. Cl.
*D21H 23/28* (2006.01)
*D21H 11/16* (2006.01)
(Continued)

(52) U.S. Cl.
CPC ..... *D21H 23/28* (2013.01); *D21H 1/02* (2013.01); *D21H 11/16* (2013.01); *D21H 15/02* (2013.01); *D21H 17/28* (2013.01); *D21H 19/54* (2013.01)

(58) Field of Classification Search
CPC ..... D21H 11/16; D21H 11/18; D21H 23/28
See application file for complete search history.

(56) References Cited

U.S. PATENT DOCUMENTS 3,098,785 A 7/1963 Meiler
3,388,037 A 6/1968 Asplund et al.
(Continued)

FOREIGN PATENT DOCUMENTS

AU 2013305802 8/2012
AU 2015218812 8/2015
(Continued)

OTHER PUBLICATIONS

Smook, Handbook for Pulp and Paper Technologists, 1992, Angus Wilde Publications, 2nd edition, chapters 13, 15, 16, and 20 (Year: 1992).*

(Continued)

*Primary Examiner* — Anthony Calandra
(74) *Attorney, Agent, or Firm* — Troutman Pepper Hamilton Sanders LLP

(57) ABSTRACT

A paper product having improved printing characteristics and a method of making the paper product. This paper product has a fibrous substrate and top layer of surface enhanced pulp fibers that is integrally coupled to the top surface of the fibrous substrate. The paper product is produced by providing an aqueous slurry formed from a blend of cellulosic fibers and water and at least partially dewatering the aqueous slurry of cellulosic fibers and water to form the fibrous substrate. Subsequently, a surface treatment
(Continued)

formed from an aqueous composition of water and surface enhanced pulp fibers is applied to the top surface of the fibrous substrate and thereafter the treated fibrous substrate is dried to form a paper product having enhanced printing characteristics.

20 Claims, 7 Drawing Sheets

(51) Int. Cl.

| | |
|---|---|
| ***D21H 15/02*** | (2006.01) |
| ***D21H 17/28*** | (2006.01) |
| ***D21H 19/54*** | (2006.01) |
| ***D21H 27/30*** | (2006.01) |

(56) References Cited

U.S. PATENT DOCUMENTS

| | | | |
|---|---|---|---|
| 3,708,130 | A | 1/1973 | Perry |
| 3,794,558 | A | 2/1974 | Back |
| 3,891,499 | A | 6/1975 | Kato et al. |
| 3,920,508 | A | 11/1975 | Yonemori |
| 3,966,543 | A | 6/1976 | Cayle et al. |
| 4,012,279 | A | 3/1977 | Selander et al. |
| 4,054,625 | A | 10/1977 | Kozlowski et al. |
| 4,247,362 | A | 1/1981 | Williams |
| 4,635,864 | A | 1/1987 | Peterson et al. |
| 5,110,412 | A | 5/1992 | Fuentes et al. |
| 5,248,099 | A | 9/1993 | Lahner et al. |
| 5,308,449 | A | 5/1994 | Fuentes et al. |
| 5,695,136 | A | 12/1997 | Rohden et al. |
| 5,731,080 | A | 3/1998 | Cousin et al. |
| 5,824,364 | A | 10/1998 | Cousin et al. |
| 5,954,283 | A | 9/1999 | Matthew |
| 6,156,118 | A | 12/2000 | Silenius |
| 6,165,317 | A | 12/2000 | Sabourin |
| 6,251,222 | B1 | 6/2001 | Silenius et al. |
| 6,296,736 | B1 | 10/2001 | Hsu et al. |
| 6,375,974 | B1 | 4/2002 | Ito et al. |
| 6,599,391 | B2 | 7/2003 | Silenius et al. |
| 6,773,552 | B1 | 8/2004 | Albert et al. |
| 6,861,380 | B2 | 3/2005 | Garnier et al. |
| 6,887,350 | B2 | 5/2005 | Garnier et al. |
| 6,935,589 | B1 | 8/2005 | Matthew |
| 6,946,058 | B2 | 9/2005 | Hu |
| 6,955,309 | B2 | 10/2005 | Matthew et al. |
| 7,381,294 | B2 | 6/2008 | Suzuki et al. |
| 7,624,879 | B2 | 12/2009 | Frances |
| 7,741,234 | B2 | 6/2010 | Smith et al. |
| 7,942,964 | B2 | 5/2011 | Luo et al. |
| 8,871,057 | B2 | 10/2014 | Gane et al. |
| 9,879,361 | B2 | 1/2018 | Pande et al. |
| 9,920,484 | B2 | 3/2018 | Marcoccia et al. |
| 9,988,762 | B2 | 6/2018 | Bilodeau et al. |
| 10,563,356 | B2 | 2/2020 | Marcoccia et al. |
| 10,704,165 | B2 | 7/2020 | Pande et al. |
| 10,710,930 | B2 | 7/2020 | Marcoccia et al. |
| 2002/0059886 | A1 | 5/2002 | Merkley et al. |
| 2002/0069791 | A1 | 6/2002 | Merkley et al. |
| 2002/0084046 | A1 | 7/2002 | Hsu et al. |
| 2003/0111197 | A1 | 6/2003 | Hu |
| 2004/0112558 | A1 | 6/2004 | Garnier et al. |
| 2004/0112997 | A1 | 6/2004 | Matthew et al. |
| 2004/0180184 | A1 | 9/2004 | Fillion et al. |
| 2004/0241350 | A1 | 12/2004 | Koga et al. |
| 2005/0194477 | A1 | 9/2005 | Suzuki |
| 2006/0006264 | A1 | 1/2006 | Sabourin et al. |
| 2007/0164143 | A1 | 7/2007 | Sabourin et al. |
| 2008/0148999 | A1 | 6/2008 | Luo et al. |
| 2008/0227161 | A1 | 9/2008 | Levie et al. |
| 2009/0145562 | A1 | 6/2009 | Nguyen |
| 2009/0145842 | A1 | 6/2009 | Frances |
| 2009/0162602 | A1 | 6/2009 | Cottier et al. |
| 2009/0221812 | A1 | 9/2009 | Ankerfors et al. |
| 2009/0266500 | A1 | 10/2009 | Schubert et al. |
| 2010/0065236 | A1 | 3/2010 | Henriksson et al. |
| 2010/0218908 | A1 | 9/2010 | Silenius et al. |
| 2010/0288456 | A1 | 11/2010 | Westland et al. |
| 2011/0277947 | A1 | 11/2011 | Hua et al. |
| 2011/0314726 | A1 | 12/2011 | Jameel et al. |
| 2012/0007363 | A1 | 1/2012 | Wang |
| 2012/0012031 | A1 | 1/2012 | Husband et al. |
| 2013/0202870 | A1 | 8/2013 | Malmborg et al. |
| 2014/0057105 | A1 | 2/2014 | Pande et al. |
| 2014/0116635 | A1 | 5/2014 | Porto et al. |
| 2014/0180184 | A1 | 6/2014 | Duguid |
| 2014/0209260 | A1 | 7/2014 | Li et al. |
| 2014/0209264 | A1 | 7/2014 | Tirimacco et al. |
| 2014/0302117 | A1 | 10/2014 | Moen et al. |
| 2015/0299955 | A1 | 10/2015 | Laukkanen et al. |
| 2016/0333524 | A1 | 11/2016 | Pande et al. |
| 2016/0340802 | A1 | 11/2016 | Pande et al. |
| 2017/0058457 | A1 | 3/2017 | Marcoccia et al. |
| 2017/0073893 | A1 | 3/2017 | Bilodeau et al. |
| 2017/0226009 | A1 | 8/2017 | Marcoccia et al. |
| 2018/0105986 | A1 | 4/2018 | Harshad et al. |
| 2018/0148895 | A1 | 5/2018 | Marcoccia et al. |
| 2019/0218716 | A1 | 7/2019 | Hoglund et al. |
| 2019/0242062 | A1 | 8/2019 | Harshad et al. |
| 2020/0063353 | A1 | 2/2020 | Everett et al. |
| 2020/0308769 | A1 | 10/2020 | Pande et al. |
| 2020/0325629 | A1 | 10/2020 | Marcoccia et al. |
| 2020/0340155 | A1 | 10/2020 | Pande et al. |

FOREIGN PATENT DOCUMENTS

| | | |
|---|---|---|
| CA | 2883161 | 2/2014 |
| CN | 1516768 | 7/2004 |
| CN | 1718914 | 1/2006 |
| CN | 101691700 | 4/2010 |
| CN | 102971462 | 3/2013 |
| CN | 103590283 | 2/2014 |
| EP | 0333209 | 9/1989 |
| EP | 0333212 | 9/1989 |
| EP | 2220291 | 5/2017 |
| FR | 2520769 | 8/1983 |
| JP | S58-136895 | 8/1983 |
| JP | H02229747 | 9/1990 |
| JP | H03122038 | 5/1991 |
| JP | H04194097 | 7/1992 |
| JP | H 04263699 | 9/1992 |
| JP | H07165456 | 6/1995 |
| JP | H08197836 | 8/1996 |
| JP | H08284090 | 10/1996 |
| JP | H09-124950 | 5/1997 |
| JP | 2002194691 | 7/2002 |
| JP | 2004525284 | 8/2004 |
| JP | 2004360088 | 12/2004 |
| JP | 2007231438 | 9/2007 |
| JP | 2010125694 | 6/2010 |
| JP | 2012526923 | 11/2012 |
| JP | 2015526608 | 9/2015 |
| JP | 2018135631 | 8/2018 |
| KR | 2004/0022874 | 3/2004 |
| KR | 1020050086850 | 8/2005 |
| KR | 10-0662043 B | 12/2006 |
| KR | 10-2010-0090745 | 8/2010 |
| KR | 1020130132381 | 12/2013 |
| RU | 2224060 | 2/2004 |
| RU | 2309211 | 10/2007 |
| RU | 2358055 | 6/2009 |
| WO | WO 96/04424 | 2/1996 |
| WO | WO 98/23814 | 6/1998 |
| WO | WO 02/14606 | 2/2002 |
| WO | WO 2002/095129 | 11/2002 |
| WO | WO 2004/101889 | 11/2004 |
| WO | WO 2009/038730 | 3/2009 |
| WO | WO 2009/155541 | 12/2009 |
| WO | WO 2010/134868 | 11/2010 |
| WO | WO 2012/007363 | 1/2012 |
| WO | WO 2012/101331 | 8/2012 |
| WO | WO 2014/031737 | 2/2014 |
| WO | WO 2014/106684 | 7/2014 |

(56) References Cited

FOREIGN PATENT DOCUMENTS

| | | |
|---|---|---|
| WO | WO 2015/127233 | 8/2015 |
| WO | WO 2015/127239 | 8/2015 |
| WO | WO 2018/026804 | 2/2018 |
| WO | WO 2018/051275 | 3/2018 |
| WO | WO 2019/152969 | 8/2019 |

OTHER PUBLICATIONS

Liner, International Paper [downloaded online from www.internationalpaper.com] downloaded on Aug. 3, 2021 (Year: 2021).*
Norton, Sarilee, Lightweight Containerboard in North America—"can you hear me now?", Jan./Feb. 2013, PaperAge, p. 18-21. (Year: 2013).*
Demuner et al., "Ultra low intensity refining of eucalyptus pulps." *Scientific and technical advances in refining and mechanical pulping 2005*.
Joy et al., "Ultra-Low intensity refining of short fibered pulps." *African Pulp and Paper Week* 2004 retrieved from URL:< https://www.tappsa.eo.za/archive2/APPW_2004/Title2004/Ultra-low_intensity_refining/ultra-low_intensity_refining.html>.
Office Action issued in corresponding European Patent No. 17195921 dated Apr. 17, 2019.
Applicant Initiated Interview Summary for U.S. Appl. No. 13/836,760, dated Sep. 27, 2017.
Applicant Initiated Interview Summary for U.S. Appl. No. 13/836,760, dated May 9, 2017.
Declaration of Harshad Pande and Bruno Marcoccia, filed in U.S. Appl. No. 13/836,760, dated Oct. 12, 2016.
Extended European Search Report issued in European Application No. 17195921.6, dated Nov. 20, 2017.
Final Office Action issued in U.S. Appl. No. 13/836,760, dated May 12, 2016.
Final Office Action issued in U.S. Appl. No. 13/836,760, dated Jan. 27, 2017.
Handbook of Pulping and Papermaking, C. Biermann, Academic Press; 2nd Edition (Aug. 5, 1996), p. 145.
Intention to grant for European patent No. 13759601.1, dated Jul. 25, 2017.
International Preliminary Report on Patentability for PCT Application No. PCT/US2015/016865, dated Aug. 23, 2016.
International Preliminary Report on Patentability for PCT Application No. PCT/US2015/016858, dated Aug. 23, 2016.
International Preliminary Report on Patentability for PCT Application No. PCT/US2013/055971, dated Feb. 24, 2015.
International Search Report and Written Opinion for PCT Application No. PCT/US2015/016865, dated May 20, 2015.
International Search Report and Written Opinion for PCT Application No. PCT/US2015/016858, dated May 15, 2015.
International Search Report and Written Opinion for PCT Application No. PCT/US2013/055971, dated Oct. 14, 2013.
International Search Report and Written Opinion issued in International Application No. PCT/US17/44881, dated Oct. 18, 2017.
International Search Report and Written Opinion Issued in PCT Application No. PCT/US2017/057161, dated Dec. 22, 2017.
La Vrykova-Marrain et al., "Characterizing the drainage resistance of pulp and microfibrillar suspensions using hydrodynamic flow measurements," TAPPI's PaperCon 2012 Conference.
Non-Final Office Action for U.S. Appl. No. 13/836,760, dated Oct. 15, 2015.
Non-Final Office Action issued in U.S. Appl. No. 15/120,220, dated Jul. 13, 2017.
Notice of Acceptance for Australian Application No. 2013305802, dated Apr. 21, 2017.
Notice of Acceptance for New Zealand Application No. 705191, dated Apr. 13, 2017.
Notice of Allowance for Canadian Patent Application No. 2,883,161, dated Jan. 3, 2017.
Notice of Allowance for U.S. Appl. No. 15/120,220, dated Nov. 6, 2017.
Notice of Allowance Issued in Corresponding Chinese Application No. 201580020488.7, dated Apr. 8, 2018.
Notice of Grant for Chinese Application No. 201380054919.2, dated Nov. 14, 2017.
Office Action Issued in Corresponding Japanese Patent Application No. 2016-552985, dated Apr. 10, 2018.
Pal et al., "A Simple Method for Calculation of the Permeability Coefficient of Porous Media," TAPPI Journal, 5(9):10-16, (2006).
Restriction Requirement for U.S. Appl. No. 13/836,760, dated Jul. 16, 2015.
Teixeira, "Recycled Old Corrugated Container Fibers for Wood-Fiber Cement Sheets," International Scholarly Research Network 2012(923413): 1-8, 2012.
Tonoli et al., "Effect of Fibre morphology on flocculation of fibre-cement suspensions," Cement and Concrete Research, 39:1017-1022, (2009).
Brazilian Search Report Issued in Corresponding Brazilian Patent Application No. BR112015003819-0, dated Sep. 9, 2019.
Office Action Issued in Corresponding Korean Patent Application No. 10-2015-7006955, dated May 29, 2020.
Pala et al., "Refining and enzymatic treatment of secondary fibres for paperboard production: Cyberflex measurements of fibre flexibility" COST E20—Wood Fibre Cell Wall Structure 2001, 4 pages.
International Search Report and Written Opinion issued in International Patent Application No. PCT/US2019/016590, dated May 23, 2019.
Notice of Reasons for Refusal issued in Japanese Patent Application No. 2018-090071, dated May 15, 2019.
Office Action issued in Indian Patent Application No. 465/KOLNP/2015, dated May 7, 2019.
Office Action issued in Russian Patent Application No. 2018125883/12, dated Mar. 6, 2019.
Office Action Issued in Corresponding Chinese Patent Application No. 201810081469.0, dated Jan. 21, 2020.
Carvalho, et al., "A Comparative Study for Two Automated Techniques for Measuring Fiber Length," *Tappi Journal, Technical Association of The Pulp & Paper Industry*, 80(2): 137-142, 1997.

* cited by examiner

SURFACE ENHANCED PULP FIBERS AT A SUBSTRATE SURFACE

CROSS-REFERENCE TO RELATED APPLICATIONS

This application is a national phase application under 35 U.S.C. § 371 of International Application No. PCT/US2017/044881, filed Aug. 1, 2017, which claims priority to and the benefit of U.S. Provisional Applications No. 62/369,362, filed Aug. 1, 2016, and No. 62/374,341, filed Aug. 12, 2016. The contents of the referenced patent applications are incorporated into the present application by reference.

FIELD

The present invention relates generally to the use of surface enhanced pulp fibers on the top surface of a fibrous substrate and particularly to the placement of surface enhanced pulp fibers on a substrate fibrous structure surface to form a desired surface morphology.

BACKGROUND

For many printing and writing grades of paper, it is desired to have a smooth surface that has desirable strength and porosity characteristics. It is known to apply starch solutions to the paper surface to enhance the surface strength of the paper for end-use applications such as various types of printing. The starch is normally applied at the wet-end (internal sizing) of the conventional paper machine apparatus and/or at the size press (external sizing) on the conventional paper machine. It is also known that the type and amount of starch applied can impact the physical-chemical properties of the paper and the properties of the produced paper product.

An additional path to increased strength of produced paper is to increase the degree of bonding of the fibers that are used in the paper making process. Positively, the resulting strength increase of the paper resulting from the increased fiber bonding could then allow for a reduction in the amount of starch required, which would result in a significant cost savings, while maintaining surface chemistry properties and surface strength.

It is known to use pulp fibers, such as wood pulp fibers, in a variety of products including, for example and without limitation, pulp, paper, paperboard, biofiber composites (e.g., fiber cement board, fiber reinforced plastics, and the like), absorbent products (e.g., fluff pulp, hydrogels, and the like), specialty chemicals derived from cellulose (e.g., cellulose acetate, carboxymethyl cellulose (CMC), and the like), and other products. The pulp fibers can be obtained from a variety of wood types including hardwoods (e.g., oak, gum, maple, poplar, eucalyptus, aspen, birch, and the like), softwoods (e.g., spruce, pine, fir, hemlock, southern pine, redwood, and the like), and non-woods (e.g., kenaf, hemp, straws, bagasse, and the like). It is also known that the properties of the pulp fibers can impact the properties of the produced product, the properties of intermediate products, and the performance of the respective manufacturing processes used to make the products (e.g., paper machine productivity and cost of manufacturing).

It is known that pulp fibers can be processed in a number of ways to achieve different desired properties. In some existing processes, pulp fibers can be conventionally refined either mechanically and/or chemically prior to incorporation into an end product. Undesirably, the refining process can cause significant reductions in length of the fibers and, in the refining process, can generate undesirable amounts of fines. Further, conventional refining processes can impact the physical characteristics of the fibers in a manner that can adversely affect the produced product, an intermediate product, and/or the manufacturing process. For example, the generation of fines can be disadvantageous in some applications because fines can slow drainage, increase water retention, and increase wet-end chemical consumption in papermaking which may be undesirable in some processes and applications.

Prior to processing into pulp, paper, paperboard, biofiber composites, absorbent products, specialty chemicals derived from cellulose and like products, conventional fibers in wood pulp typically have a length weighted average fiber length ranging between 0.5 and 3.0 millimeters. In conventional refining techniques, fibers are passed usually only once, but generally no more than 2-3 times, through a refiner, which results in a reduction in the length weighted average fiber length of the refined fiber. This refining is typically done at a relatively low energy (for example, about 20-80 kwh/t for hardwood fibers) and conventionally uses a specific edge load of about 0.4-0.8 Ws/m for hardwood fibers, which, in turn, conventionally results in a shorten length weighted average fiber length post refining when compared to surface enhanced pulp fibers

SUMMARY

Described herein are a paper product and a method of making a paper product having desired/improved printing characteristics, and particularly to a paper product having a top layer of highly fibrillated surface enhanced pulp fibers. One property of the highly fibrillated surface enhanced pulp fibers disclosed herein is their ability to significantly increase fiber bonding. It is contemplated that the strength enhancing and fiber coverage properties of the surface enhanced pulp fibers can be utilized to increase the physical properties of the produced paper product and specifically, those properties of the paper substrate upon which the surface enhanced pulp fibers are applied.

In one aspect, it is contemplated to create a fibrous substrate and to subsequently apply a surface treatment, which comprises an aqueous composition, onto the top surface of the fibrous substrate. Optionally, it is contemplated that the fibrous substrate can comprise a mixture formed from at least two of hardwood pulp fibers, softwood pulp fibers, and surface enhanced pulp fibers. It is contemplated that the mixture can be formed at desired ratios of the selected pulp fibers. Optionally, the fibrous substrate can comprise at least one of a starch composition and the like.

The aqueous composition can comprise water and a plurality of surface enhanced pulp fibers. In this aspect, the surface treatment can comprise a mixture of water and the surface enhanced pulp fibers that are suspended therein the water at a desired percentage composition level. The surface enhanced pulp fibers can have, for example, a length weighted average fiber length of at least about 0.2 millimeters, at least about 0.3 millimeters, or at least about 0.4 millimeters and an average hydrodynamic specific surface area of at least about 10 square meters per gram or at least about 12 square meters per gram after being refined in a mechanical refiner having a pair of ultrafine refiner plates at a specific edge load of less than 0.2 Ws/m until an energy consumption of at least 450 kWh/ton is reached. The length weighted average length of the formed surface enhanced pulp fibers can be, for example, at least 60%, or optionally, 70%, of the length weighted average length of the fibers prior to introduction into the mechanical refiner. The increased average fiber length and increase surface area of each of the surface enhanced pulp fibers increases the bond strength of the applied layer of surface enhanced pulp fibers relative to the each other and relative to the fibers that comprise the top surface portion of the underlying fibrous substrate.

A method of making a paper product having desired physical and printing characteristics can comprise providing an aqueous slurry comprising a blend of cellulosic fibers and water and at least partially dewatering the aqueous slurry of cellulosic fibers and water to form the fibrous substrate. The method can further comprise the subsequent application of a desired surface treatment onto the top surface of the fibrous substrate. In this aspect, it is contemplated that the surface treatment can comprise the aqueous composition described above. The treated fibrous substrate can subsequently be conventionally dried and/or pressed to form a paper product having enhanced printing characteristics.

Optionally, the surface treatment can further comprise at least one of a starch composition, a conventional pigmentation composition, a conventional surface coating formulation, and the like. In one exemplary aspect, a starch composition can comprise an ethylated starch solution, which comprises from about 1.0% to 12%, by weight, of starch solids and has a viscosity of about 10 to 220 centipoise. In a further optional aspect, and prior to the application of the aqueous composition, the plurality of surface enhanced pulp fibers can be chemically reacted with a composition to enhance ink jet printing characteristics of the paper product.

It is contemplated that the aqueous composition can be applied to the top surface by use of conventional loaded aqueous dispersion apparatus, such as, for example and not meant to be limiting, a head box, a two-roll size press, a rod-metering size press, a blade coater, a fountain coater, a cascade coater, a spray applicator, and the like.

It is optionally contemplated that the plurality of surface enhanced wood pulp fibers can be screened prior to application to insure that the surface enhanced pulp fibers being applied are desirably sized.

In accordance with the present invention, the surface enhanced pulp fibers can comprise hardwood pulp refined with an energy input of at least 300 kwh/t and preferably between about 400 to about 1,800 kwh/t. In this aspect, it is contemplated that the number of surface enhanced pulp fibers can be at least 12,000 fibers/milligram on an oven-dry basis. In another aspect, the surface enhanced pulp fibers can have an average hydrodynamic specific surface area that can be at least 4 times greater or at least 6 time greater than the average specific surface area of the fibers prior to introduction into the refiner for fibrillation.

Various implementations described in the present disclosure can include additional systems, methods, features, and advantages, which can not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
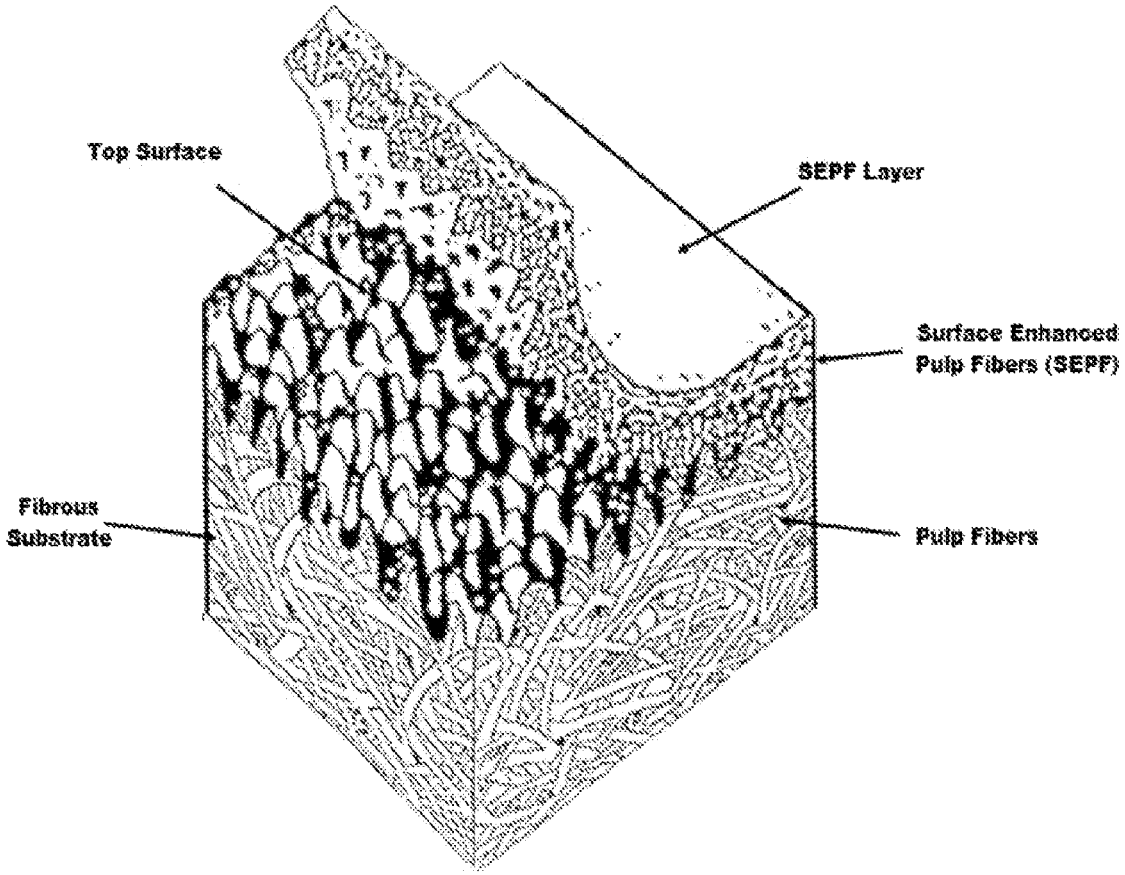
FIG. 1 is a schematic cross-sectional view of a paper product produced by the method of the present invention, showing a top layer that comprises a plurality of highly fibrillated surface enhanced pulp fibers that are integrally bonded to an underlying fibrous substrate that comprises a plurality of pulp fibers.
Figure 2:
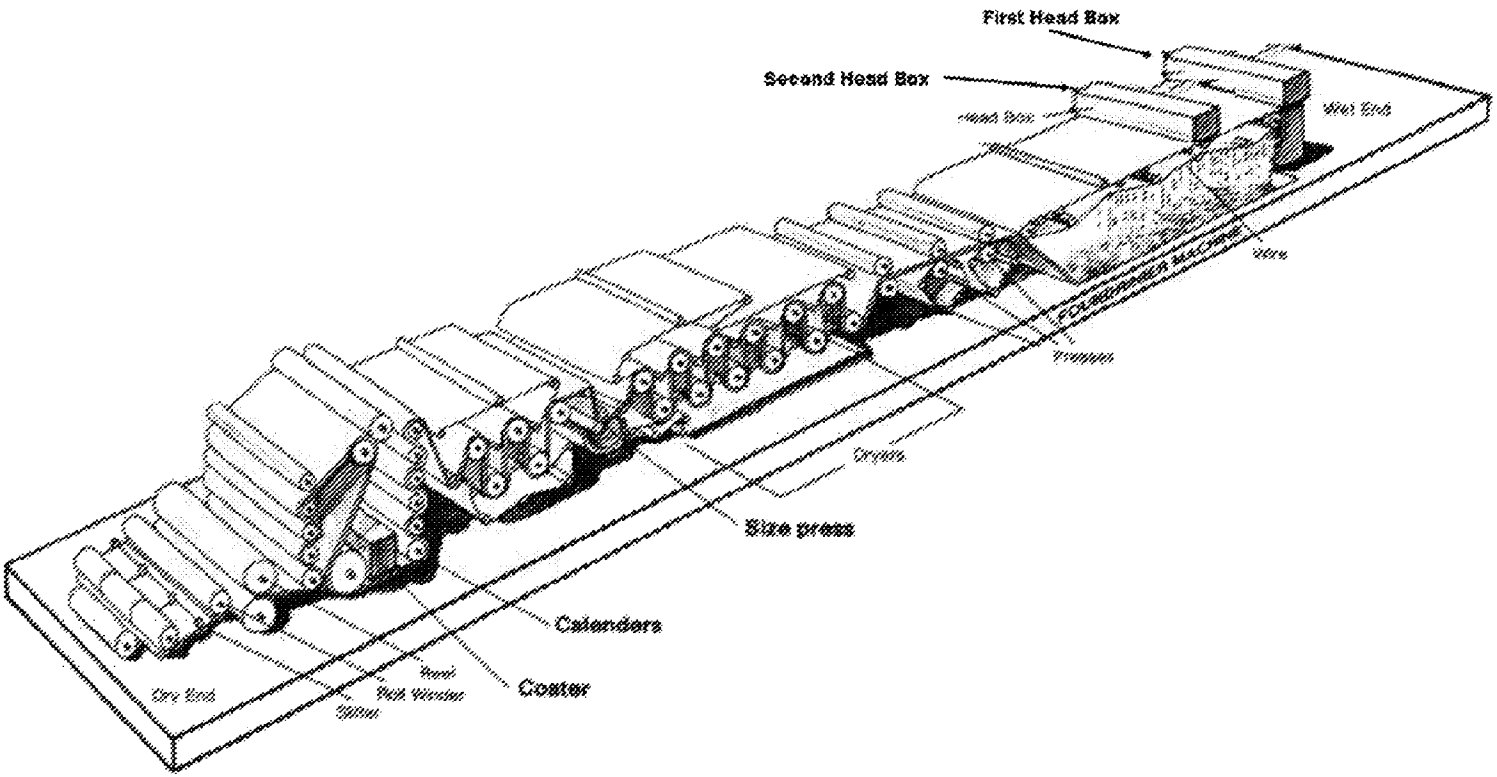
FIG. 2 is a schematic illustration of a system for making a paper product having at least two head boxes that are spaced apart in a machine direction, the first head box configured to deliver an aqueous solution comprising a mixture of pulp fibers that are refined to conventional levels of energy and water onto a moving wire to form the fibrous substrate, and the second head box configured to deliver an aqueous composition comprising a mixture of surface enhanced pulp fibers and water onto an at least partially dewatered fibrous substrate.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. It will also be apparent that the various aspects of the invention described herein may be added to other existing measurement devices/systems as an embodiment of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a refiner" can include two or more such refiners unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular embodiment.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems may be understood more readily by reference to the following detailed description of preferred embodiments and the Examples included therein and to the Figures and their previous and following description.

Disclosed herein is a paper product having desired/improved printing characteristics and a method for creating a paper product having a top layer that comprises a plurality of highly fibrillated surface enhanced pulp fibers that are integrally bonded to an underlying fibrous substrate. It is contemplated that the strength enhancing and fiber coverage properties of the surface enhanced pulp fibers can be utilized to increase the physical properties of the produced paper product and specifically, the physical and printing properties of the top layer of the paper product.

In one aspect, the paper product can comprise an underlying fibrous substrate that comprises a plurality of pulp fibers that are refined to conventional levels of energy. These pulp fibers, which can be formed from any hardwood or softwood, are typically refined at a relatively low energy and at an edge loading that fibrillates the pulp fibers to form conventional pulp fibers that have a length weighted average fiber length and an average hydrodynamic specific surface area that is less than the length weighted average fiber length and an average hydrodynamic specific surface area of surface enhanced pulp fibers. For example, hardwood fiber can be conventionally refined until about 20-80 kWh/ton is reached at a specific edge load of about 0.4-0.8 Ws/m to produce pulp fibers that are suitable for conventional paper making processes.

It is contemplated that the fibrous substrate can comprise a mixture formed from at least two of hardwood pulp fibers, softwood pulp fibers, and surface enhanced pulp fibers. It is contemplated that the mixture can be formed at desired ratios of the selected pulp fibers. In another aspect, it is contemplated that the pulp fibers that comprise the fibrous substrate can comprise a mixture of hardwood and softwood pulp fibers. In various aspects, the ratio of hardwood to softwood fibers present in the fibrous substrate can be about 5:1; 4:1; 3:1, 2:1; 1:1; 1:2; 1:3; 1:4; and 1:5. In a mixture forming the fibrous substrate comprising surface enhanced pulp fibers, the surface enhanced pulp fibers can comprise between about 2 to about 25 percent, by weight, of the formed fibrous substrate, preferably between about 2 to about 15 percent, by weight, of the formed fibrous substrate, and most preferred of about 5 to about 10 percent, by weight, of the formed fibrous substrate. Optionally, the fibrous substrate can comprise at least one of a starch composition and the like. It is contemplated that fibrous substrate characteristics such as strength, porosity (related to "tightness" of the sheet structure), offset pick resistance and surface pore size distribution can be manipulated to satisfy specify specific requirements as desired.

In one aspect, in production, the method of making a paper product having improved printing characteristics can comprise creating the fibrous substrate and subsequently applying a surface treatment comprising an aqueous composition onto the top surface of the fibrous substrate. The treated fibrous substrate can subsequently be conventionally dried and/or pressed to form a paper product having enhanced printing characteristics.

It is contemplated that the surface treatment can comprise a plurality of surface enhanced pulp fibers, which are characterized by having increased surface area relative to conventionally refined pulp fibers and which are described in more detail below. The plurality of surface enhanced pulp fiber are suspended in a liquid medium, such as, for example, water. In one exemplary aspect, the surface treatment can comprise a mixture of water and the surface enhanced pulp fibers that are suspended therein the water at a desired percentage composition level. The optimum average fiber length and increase surface area of each of the surface enhanced pulp fibers synergistically acts to increase the bond strength of the applied layer of surface enhanced pulp fibers relative to the each other and relative to the fibers that comprise the top surface portion of the underlying fibrous substrate.

In one example, the surface treatment can be applied to a top surface of the fibrous substrate at a desired weight composition of surface enhanced pulp fiber that provides for substantial coverage of gaps and/or holes existing in the underlying top surface of the fibrous substrate. In various exemplary aspects, the surface enhanced pulp fibers can be applied to the fibrous substrate in the aqueous composition at a consistency of between about 0.1 to about 10.0 percent, preferably between about 0.5 to about 7.5 percent, and most preferred at a consistency of about 0.3 to about 1.5 percent. As used herein, the term "consistency" refers to the concentration of the aqueous composition, i.e., the concentration of the pulp fiber in the aqueous fiber suspension. TAPPI standard (T240) Pulp consistency describes the measurement of pulp consistency (concentration) of aqueous fiber suspensions. For example, it is contemplated that the desired weight composition of the applied surface enhanced pulp fibers in the formed paper product can be between about 1 to about 20 gsm, preferably between about 1 to 10 gsm, and most preferred between about 3 to about 5 gsm.

It is contemplated that the fibrous substrate in the formed paper product can have a weight composition between about 10 to about 300 gsm, preferably between about 20 to about 100 gsm, and most preferred between about 30 to about 75 gsm. It is further contemplated that the relative weigh composition of the fibrous substrate and the top layer comprising surface enhance pulp fibers can be scalable as desired. In this aspect, the desired weight composition of the surface enhanced pulp fibers in the formed paper product can be between about 1 to about 25 percent, preferably between about 2 to about 20 percent, and most preferred between 5 and 10 percent of the weight composition of the fibrous substrate in the formed paper product.

Optionally, the surface treatment can further comprise at least one of a starch composition, a conventional pigmentation composition; a conventional surface coating formulation, and the like. In exemplary aspects, the surface treatment can further comprise an ethylated starch solution, an ethylated starch/ground calcium carbonate (GCC) mixture, an ethylated starch wherein the whole formulation was treated with a proprietary starch encapsulation fixative enhancement, and the like.

In a further exemplary aspect, the starch composition can comprise a conventional starch such as, for example and without limitation, an ethylated starch solution, which can comprises from about 1.0% to 12%, by weight, of starch solids and has a viscosity of about 10 to 220 centipoise. Optionally, the starch composition can comprise a conventional starch which can comprises from between about 4% to about 12%, by weight, of starch solids with viscosities ranging from 20 to greater than 1000 centipoise. Optionally, the surface treatment can comprise a starch solution having between about 0.20% to 5.0%, by weight, of the surface enhanced wood pulp fibers.

In one example and without limitation, the surface treatment comprised a 7% starch and 0.5% surface enhanced fiber aqueous solution that was applied onto the top surface of the fibrous substrate. The resultant paper product showed a greater than 2 points opacity increase when compared to a 10% starch solution (without any surface enhanced pulp fibers) applied to the same fibrous substrate. This represents a significant opacity increase which is very difficult to obtain by other means.

Optionally, and prior to the application of the aqueous composition, the plurality of surface enhanced pulp fibers can be chemically reacted with a composition to enhance ink jet printing characteristics of the paper product.

Figure 3:
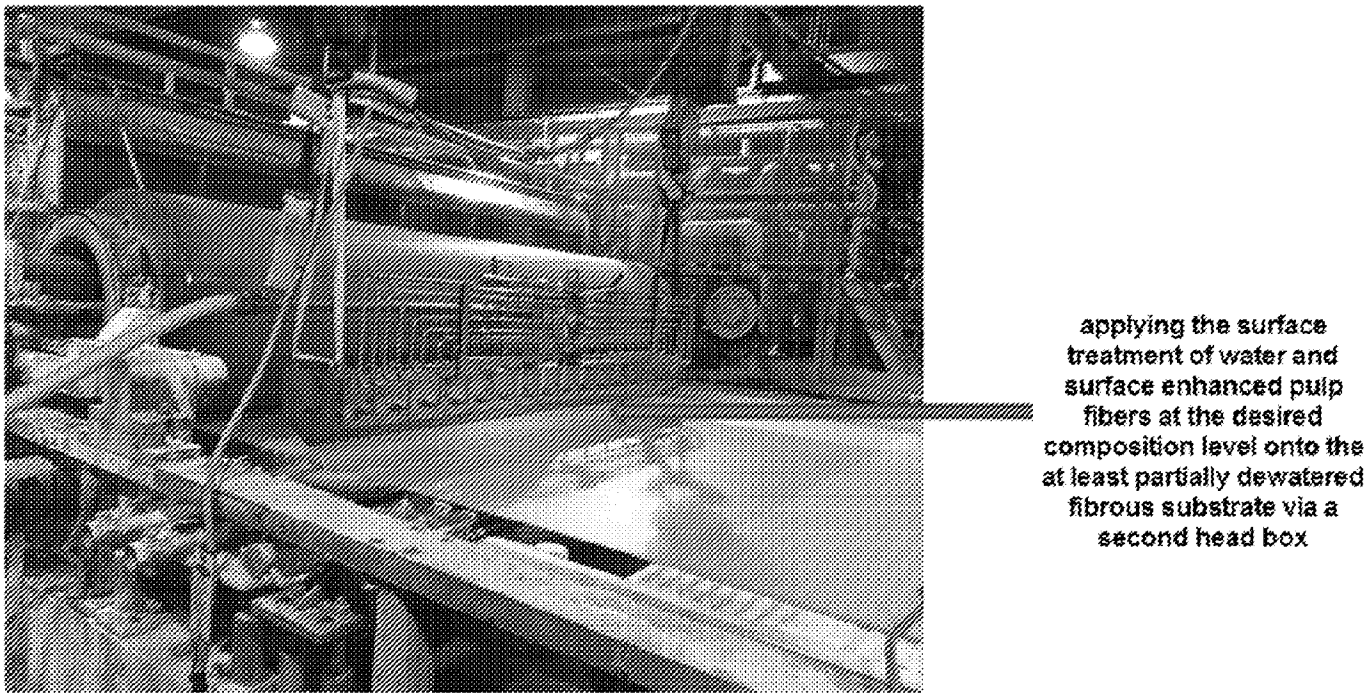
FIG. 3 is a perspective photograph showing a second head box configured to deliver an aqueous composition comprising a mixture of surface enhanced pulp fibers and water onto an at least partially dewatered fibrous substrate, and showing the at least partially fibrous substrate being at least partially dewatered via use of a conventional pressure roller positioned between the first and the second head box.

In operation, the aqueous slurry is deposited onto a wire moving in a machine direction. In one exemplary aspect, it is contemplated that the aqueous slurry can be dispersed onto the moving wire via a first head box that is configured to disperse a substantially uniform layer of the aqueous slurry at the desired fibrous substrate weight composition onto the moving wire. In another aspect, the aqueous composition can be dispersed onto the top surface of the fibrous substrate via a second head box, which is spaced from the first head box downstream along the machine direction. In this aspect, the second head box is configured to disperse a substantially uniform layer of the aqueous composition at the desired weight composition onto the top surface of the fibrous substrate. Optionally, and as shown in FIG. 3, the aqueous slurry can be at least partially dewatered via the application of a conventional roller that positioned between the respective first and second head boxes and is configured to apply pressure to the aqueous slurry.

It is contemplated that the aqueous slurry and the aqueous composition can be dispensed or otherwise applied by use of conventional loaded aqueous dispersion apparatus, such as, for example and not meant to be limiting, a two-roll size press, a rod-metering size press, a blade coater, a fountain coater, a cascade coater, a spray applicator, and the like.

The formed plurality of surface enhanced wood pulp fibers can be screened prior to application to insure that the surface enhanced pulp fibers being applied in the aqueous composition are desirably sized. In this aspect, it is contemplated that the plurality of surface enhanced wood pulp fibers can be screened prior to the applying step to remove relatively larger fiber fragments to enhance printing characteristics. In another aspect, during the applying step, the surface treatment can be applied to the fibrous substrate to provide coverage of gaps and/or holes existing in the fibrous substrate, preferably, the coverage to provide a substantially uniform top surface for the formed paper product.

The paper product formed by the methodology of the present disclosure exhibits decreased reduction (net increase) in opacity after sizing. Opacity is usually highly correlated to the efficiency of light scattering by the materials comprising the sheet, primarily the fiber structure and pigment filler. High light scattering efficiency will be achieved if there is a high incidence of spaces within the paper, micro gaps between fibers and other components present in the paper. Notably, it has been found that the plurality of surface enhanced pulp fibers can desirably function as a sizing agent, acting to close up the surface of an associated substrate, such as fabric or paper formed from cellulosic material. It is contemplated that the application of the aqueous composition comprising the plurality of surface enhanced pulp fibers to the top surface of the fibrous substrate can cover the holes and/or gaps that are present on the formed top surface of the fibrous substrate. A combination of optimized fibrous substrate and the application of the surface enhanced pulp fibers at the top surface of the substrate can result in a paper with superior print quality.

Embodiments of the present invention relate generally to surface enhanced pulp fibers, methods for producing, applying, and delivering surface enhanced pulp, products incorporating surface enhanced pulp fibers, and methods for producing, applying, and delivering products incorporating surface enhanced pulp fibers, and others as will be evident from the following description. The surface enhanced pulp fibers are fibrillated to an extent that provides desirable properties as set forth below and may be characterized as being highly fibrillated. In various embodiments, surface enhanced pulp fibers described herein have significantly higher surface areas without significant reductions in fiber lengths, as compared to conventional refined fibers, and without a substantial amount of fines being generated during fibrillation. Such surface enhanced pulp fibers can be useful in the production of pulp, paper, and other products as described herein.

The pulp fibers that can be surface enhanced according to embodiments of the present invention can originate from a variety of wood types, including hardwood and softwood. Non-limiting examples of hardwood pulp fibers that can be used in some embodiments of the present invention include, without limitation, oak, gum, maple, poplar, *eucalyptus*, aspen, birch, and others known to those of skill in the art. Non-limiting examples of softwood pulp fibers that can be used in some embodiments of the present invention include, without limitation, spruce, pine, fir, hemlock, southern pine, redwood, and others known to those of skill in the art. The pulp fibers may be obtained from a chemical source (e.g., a Kraft process, a sulfite process, a soda pulping process, and the like), a mechanical source, (e.g., a thermomechanical process (TMP), a bleached chemi-thermomechanical process (BCTMP), and the like), or combinations thereof. It is contemplated that the pulp fibers can also originate from non-wood fibers such as linen, cotton, bagasse, hemp, straw, kenaf, and the like. Optionally, the pulp fibers can be bleached, partially bleached, or unbleached with varying degrees of lignin content and other impurities. In some aspects, the pulp fibers can be recycled fibers or post-consumer fibers.

The plurality of surface enhanced pulp fibers can be characterized according to various properties and combinations of properties including, for example, length, specific surface area, change in length, change in specific surface area, surface properties (e.g., surface activity, surface energy, and the like), percentage of fines, drainage properties (e.g., Schopper-Riegler), crill measurement (fibrillation), water absorption properties (e.g., water retention value, wicking rate, and the like), and various combinations thereof. While the following description may not specifically identify each of the various combinations of properties, it will be understood by one skilled in the art that different surface enhanced pulp fibers may possess one, more than one, or all of the properties described herein.

In various exemplary aspects, the surface enhanced pulp fibers can have a length weighted average fiber length of at least about 0.2 millimeters, at least about 0.3 millimeters, or at least about 0.4 millimeters and an average hydrodynamic specific surface area of at least about 10 square meters per gram or, more preferred, at least about 12 square meters per gram. In one non-limiting example, the surface enhanced pulp fibers are formed by being fibrillated in a mechanical refine at a specific edge load of less than 0.2 Ws/m until an energy consumption of at least 450 kWh/ton is reached. As used herein, "specific edge load" (or SEL) is a term understood to those of ordinary skill in the art to refer to the quotient of net applied power divided by the product of rotating speed and edge length. SEL is used to characterize the intensity of refining and is expressed as Watt-second/meter (Ws/m).

In a further aspect, it is contemplated that the number of surface enhanced pulp fibers can be at least 12,000 fibers/milligram on an oven-dry basis. As used herein, "oven-dry basis" means that the sample is dried in an oven set at 105° C. for 24 hours.

The plurality of surface enhanced pulp fibers are formed in a refiner, or a series of refiners, in which at least one refiner has a pair of ultrafine refiner plates. In this aspect, the ultrafine refining plates have a bar width of 1.0 millimeters or less and a groove width of 1.6 millimeters or less. The desired plurality of surface enhanced pulp fibers can be produced by fibrillating the pulp fibers at a low specific edge load with the pair of ultrafine refiner plates until the desired energy consumption is reached. It is contemplated that the refiner can be operated at a specific edge load between about 0.1 and about 0.3 Ws/m, preferably at a specific edge load between about 0.1 and about 0.2 Ws/m, and most preferably at a specific edge load of less than 0.2 Ws/m.

As used herein, the length weighted average length is measured using a LDA02 Fiber Quality Analyzer or a LDA96 Fiber Quality Analyzer, each of which are from OpTest Equipment, Inc. of Hawkesbury, Ontario, Canada, and in accordance with the appropriate procedures specified in the manual accompanying the Fiber Quality Analyzer.

The surface enhanced pulp fibers production methodology allows for the preservation of the lengths of the fibers during the fibrillation process. In some aspects, the plurality of surface enhanced pulp fibers can have a length weighted average length that is at least 60% of the length weighted average length of the fibers prior to fibrillation. A plurality of surface enhanced pulp fibers, according to optional aspects, can have a length weighted average length that is at least 70% of the length weighted average length of the fibers prior to fibrillation.

In a further aspect, the surface enhanced pulp fibers of the present invention advantageously have large hydrodynamic specific surface areas which can be useful in some applications, such the paper making process described herein. As noted above, the surface enhanced pulp fibers can have an average hydrodynamic specific surface area of at least about 10 square meters per gram, and more preferably at least about 12 square meters per gram. For illustrative purposes, a typical unrefined papermaking fiber would generally have a hydrodynamic specific surface area of about 2 m2/g. Further, a typical fiber that is refined conventional to a low energy, such as less than 60 kwh/t or less than 100 kwh/t, would generally have a hydrodynamic surface area that is less than a surface enhanced pulp fiber. As used herein, hydrodynamic specific surface area is measured pursuant to the procedure specified in Characterizing the Drainage Resistance of Pulp and Microfibrillar Suspensions using Hydrodynamic Flow Measurements, N. Lavrykova-Marrain and B. Ramarao, TAPPI's PaperCon 2012 Conference, available at http://www.tappi.org/Hide/Events/12PaperCon/Papers/12PAP116.aspx, which is hereby incorporated herein in its entirety by reference.

The hydrodynamic specific surface areas of the surface enhanced pulp fibers are significantly greater than that of the fibers prior to fibrillation. In some aspects, the plurality of surface enhanced pulp fibers can have an average hydrodynamic specific surface area that is at least 4 times greater than the average specific surface area of the fibers prior to fibrillation, preferably at least 6 times greater than the average specific surface area of the fibers prior to fibrillation, and most preferably at least 8 times greater than the average specific surface area of the fibers prior to fibrillation.

As noted above, the surface enhanced pulp fibers used herein advantageously have increased hydrodynamic specific surface areas while preserving fiber lengths. It has been noted that the effective increase in the hydrodynamic specific surface area can provide for increased fiber bonding, absorbing water or other materials, retention of organics, higher surface energy, and other positive effects.

In the refinement of pulp fibers to provide surface enhanced pulp fibers, some aspects preferably minimize the generation of fines. As used herein, the term "fines" is used to refer to pulp fibers having a length of 0.2 millimeters or less. In some aspects, surface enhanced pulp fibers can have a length weighted fines value of less than 40%, more preferably less than 22%, with less than 20% being most preferred. As used herein, "length weighted fines value" is measured using a LDA02 Fiber Quality Analyzer or a LDA96 Fiber Quality Analyzer, each of which are from OpTest Equipment, Inc. of Hawkesbury, Ontario, Canada, and in accordance with the appropriate procedures specified in the manual accompanying the Fiber Quality Analyzer.

In one aspect, the surface enhanced pulp fibers have a preserved length and relatively high specific surface area without generation of a large number of fines during the production of the surface enhanced pulp fibers. Further, the surface enhanced pulp fibers can simultaneously possess one or more of the following properties: length weighted average fiber length; change in average hydrodynamic specific surface area; and/or surface activity properties. It is contemplated that such surface enhanced pulp fibers can minimize the negative effects on drainage while also retaining or improving the strength of products in which they are incorporated.

With regard to physical properties, the surface enhanced pulp fibers can improve the strength of a paper product. For example, incorporating a plurality of surface enhanced pulp fibers according to some embodiments of the present invention into a paper product, either in a top layer, in the fibrous substrate, or in both the top layer and the fibrous substrate, can improve the strength of the final product. In some aspects, a paper product incorporating at least 3 weight percent surface enhanced pulp fibers can result in higher wet-web strength and/or dry strength characteristics, can improve runnability of a paper machine at higher speeds, and/or can improve process performance, while also improving production. Incorporating between about 2 and about 20 weight percent surface enhanced pulp fibers can help improve the strength and performance of a paper product significantly when compared to a similar product made in the same manner with substantially no surface enhanced pulp fibers. Improved properties of the formed paper product include, without limitation, opacity, porosity, absorbency, tensile energy absorption, scott bond/internal bond and/or print properties (e.g., ink density print mottle, gloss mottle).

Unless indicated to the contrary, the numerical parameters set forth in this specification are approximations that can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Example 1

Fibrous Substrate:

The fibrous substrate is generated at an approximate basis weight of 50 gsm, which comprises a fiber composition weight of approximately 45 gsm; a starch composition weight of approximately 1.8 gsm, and a retained water composition weight of approximately 3.1 gsm. The fibrous substrate is formed from 80% hardwood pulp fibers and 20% softwood fibers that are refined to conventional low energy levels (e.g., below 100 kwhr/t). No PCC or surface enhanced pulp fibers are added to the exemplary fibrous substrate.

Surface Enhanced Pulp Fibers:

For purposes of the trial, the surface enhanced pulp fibers were be refined to two separate energy levels. In one aspect, the trials were be conducted with surface enhanced pulp fibers refined to approximately 400 kwhr/t and, in a further aspect, the trials were be conducted with surface enhanced pulp fibers refined to approximately 800 kwhr/t.

In trial operation, an aqueous slurry comprising a blend of cellulosic fibers, starch and water onto was deposited thereon a wire moving in a machine direction via a first head box and was subsequently at least partially dewatered to form a fibrous substrate having a fiber composition weight of approximately 45 gsm; a starch composition weight of approximately 1.8 gsm, and a retained water composition weight of approximately 3.1 gsm. Subsequently, a surface treatment comprising an aqueous composition that comprises surface enhanced pulp fibers and water was applied to the top surface of the fibrous surface that was moving in the machine direction. The application of the aqueous composition was accomplished via the use of a second head box that was spaced downstream from the first head box in the machine direction. Subsequently, the formed treated fibrous substrate was conventionally run through the remaining portions of a conventional paper making machine to form a paper product having enhanced printing characteristics.

During the trail runs, the base weight of the formed paper product was maintained at constant basis weight and calendaring and the basis weight self-adjusts for SEPF added onto the surface.

The trail process was continually repeated with versions of the surface enhanced pulp fibers that are refined to approximately 400 kwhr/t and versions of the surface enhanced pulp fibers that are refined to approximately 800 kwhr/t. Further, for each of the versions of the surface enhanced pulp fibers, the trials were run at a gsm load levels of surface enhanced pulp fibers that are applied to the top surface of the fibrous substrate between 0 to about 10 gsm, to particularly include runs at 0, 1, 2, 3, 4, 5, 6, 7, 8, 9 and 10 gsm of surface enhanced pulp fibers. Additionally, for each of the versions of the surface enhanced pulp fibers, the trials were run at consistency levels that are between 0.5% to about 10%, to particularly include runs at 0.5%, 1%, 2%, 3%, 4%, 5%, 6%, 7%, 8%, 9% and 10%.

Example 2

Fibrous Substrate:

The fibrous substrate was generated at an approximate basis weight of 50 gsm, which comprises a fiber composition weight of approximately 45 gsm; a starch composition weight of approximately 1.8 gsm, and a retained water composition weight of approximately 3.1 gsm. The fibrous substrate was formed from 80% hardwood pulp fibers and 20% softwood fibers that are refined to conventional low energy levels (e.g., below 100 kwhr/t). No PCC or surface enhanced pulp fibers were added to the exemplary fibrous substrate.

Surface Enhanced Pulp Fibers:

For purposes of the trial, the surface enhanced pulp fibers were refined to approximately 900 kwhr/t and, in a further aspect, the trials will be conducted with surface enhanced pulp fibers refined to approximately 800 kwhr/t. Two production runs of the surface enhanced pulp fibers were conducted with the first run producing length weighted average fiber length of about 0.19 millimeters, an average hydrodynamic specific surface area of at least about 10 square meters per gram, and a length weighted fines of 66%. The second production run producing length weighted average fiber length of about 0.28 millimeters, an average hydrodynamic specific surface area of at least about 10 square meters per gram, and a length weighted fines of 43%.

In trial operation, and as shown in FIG. 3, an aqueous slurry comprising a blend of cellulosic fibers, starch and water onto was deposited thereon a wire moving in a machine direction via a first head box and was subsequently at least partially dewatered via the application of a pressure roller to form a fibrous substrate having a fiber composition weight of approximately 45 gsm; a starch composition weight of approximately 1.8 gsm, and a retained water composition weight of approximately 3.1 gsm. Subsequently, a surface treatment comprising an aqueous composition that comprises the surface enhanced pulp fibers described above and water was applied to the top surface of the fibrous surface that was moving in the machine direction. The application of the aqueous composition was accomplished via the use of a second head box that was spaced downstream from the first head box and the pressure roller in the machine direction. Subsequently, the formed treated fibrous substrate was conventionally run through the remaining portions of a conventional paper making machine to form a paper product having enhanced printing characteristics.

During the trail runs, the base weight of the formed paper product was maintained at constant basis weight and calendaring and the basis weight self-adjusts for SEPF added onto the surface.

The trail process was continually repeated with the two production runs of the surface enhanced pulp fibers that are refined to approximately 900 kwhr/t. Further, for each of the production run versions of the surface enhanced pulp fibers, the trials were run at a gsm load levels of surface enhanced pulp fibers that are applied to the top surface of the fibrous substrate between 0 to about 5 gsm, to particularly include runs at 0, 0.5, 1.0, 1.5, 2.0, 2.5, 3.0, 3.5, 4.0, 4.5, and 5.0 gsm of surface enhanced pulp fibers. Additionally, for each of the production run versions of the surface enhanced pulp fibers, the trials are run at consistency levels that are between 0.5% to about 10%, to particularly include runs at 0.5%, 1%, 2%, 3%, 4%, 5%, 6%, 7%, 8%, 9% and 10%.

Figure 4:
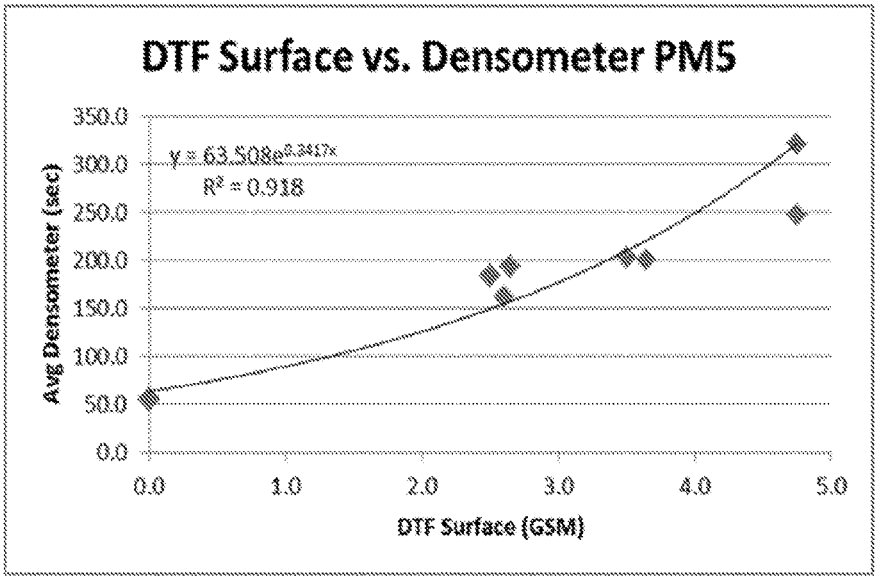
FIG. 4 is graphically illustrates the densometer results for exemplary weights of the surface enhanced pulp fibers being applied to the top surface of the formed fibrous substrate.

Referring to FIG. 4, the test runs found that an application of an aqueous composition comprising a mixture of surface enhanced pulp fibers (in an amount of at least 2 gsm) and water onto an at least partially dewatered fibrous substrate forms a paper product having a very high Gurley porosity (densometer).

Figure 5B:
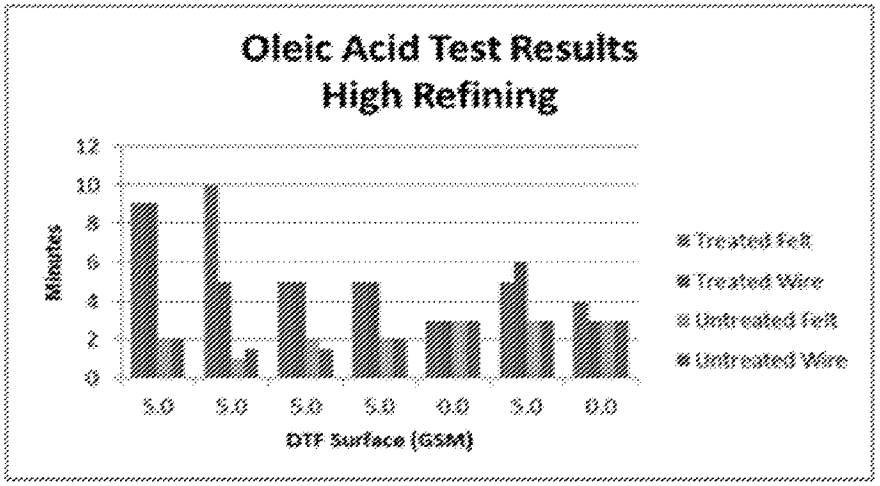
FIGS. 5A and 5B graphically illustrate the results of the Oleic acid hold out and solvent hold out testing for low refined pulp (FIG. 5A) and high refined pulp (FIG. 5B). As used herein the high refined pulp is refined to a higher energy input as compared to the low refined pulp. For example and without limitation, the high refined pulp can be refined at about twice the energy of the low refined pulp.
Figure 5A:
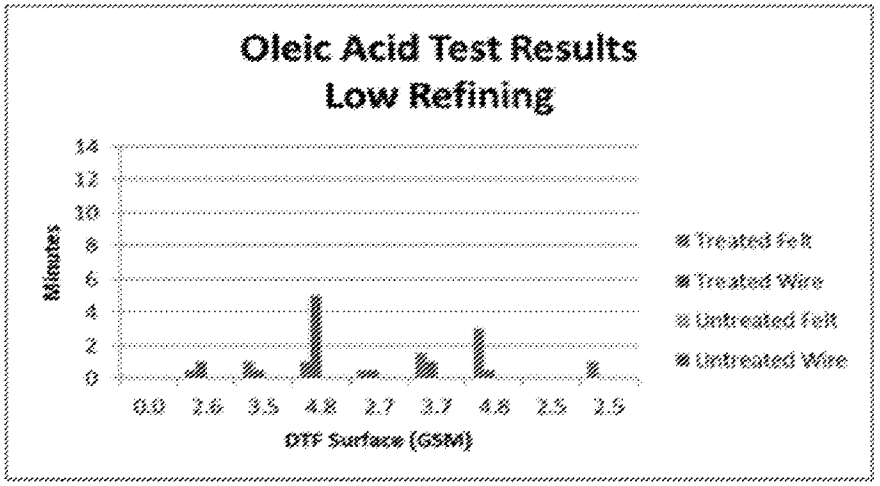

Further, as shown in FIGS. 5A and 5B, the test runs noted that generated treated paper product, having the plurality of highly fibrillated surface enhanced pulp fibers forming the top layer of the paper product, which are integrally bonded to an underlying fibrous substrate, has an increased Oleic acid hold out and solvent hold out. Add testing procedures for Oleic acid hold out test and solvent hold out test.

The Oleic acid hold out test methodology comprises placing a sample sheet of paper on top of a glossy sheet or, alternatively, on top of a template if testing multiple samples. Next, a brass cylinder is placed on top of the sample sheet and a thimble full of sand is poured into the cylinder. The cylinder is removed slowly, keeping the cylinder perpendicular to the paper to allow the sand to fall slowly into a pile on the surface of the sample sheet. One milliliter of an Oleic acid solution, comprising a mix of 99 g oleic acid to 1 g oil violet IRS, is drawn into a syringe and is applied slowly to the top of the pile of sand after which a stopwatch is initiated. The entire sample is subsequently moved to a new spot on the sample paper at a predetermined time internal and the stopwatch time is recorded for each move. The paper is marked where the sample was previously placed each time the sample is moved if a template is not being used. The paper is inspected for evidence that the oleic acid has passed through the sample sheet, which will appear as pale blue/violet spots on glossy paper. The sample is subsequently moved at the predetermined time interval until the oleic acid has passed through the sample sheet.

The solvent hold out test methodology examines the solvent strike-thorough on masking papers that require solvent holdout and provides an indication of pinhole frequency and relative size. The test uses a red marker, such as a chisel tip Sanford brand Magnum 44 marker-red and pulp blotters. In this test methodology, samples are initially cut from the paper to be tested, preferably in 8"×10" dimensions, with the 8" dimension being in the machine direction that the paper was formed. Subsequently, the samples are marked as test front, center and back, unless otherwise specified on the grade spec sheet. Next, the paper samples are positioned, felt-side up, on the pulp blotter, leaving room at the top of the pulp blotter to tape the paper sample securely to the pulp blotter. The red marker is then drawn across the sheet horizontally in approximately a 6" path, using medium hand pressure, 3 times over the same path. This action is repeated to form 3 separate visible red lines on the same sample sheet of paper. The sheet is then lifted from the pulp blotter and the pulp blotter is inspected for any red color that may have bleed though the paper sample. The pinhole count is calculated based on total number of red specs counted on the pulp blotter for the front, center and back paper samples divided by 3.

Figure 6A:
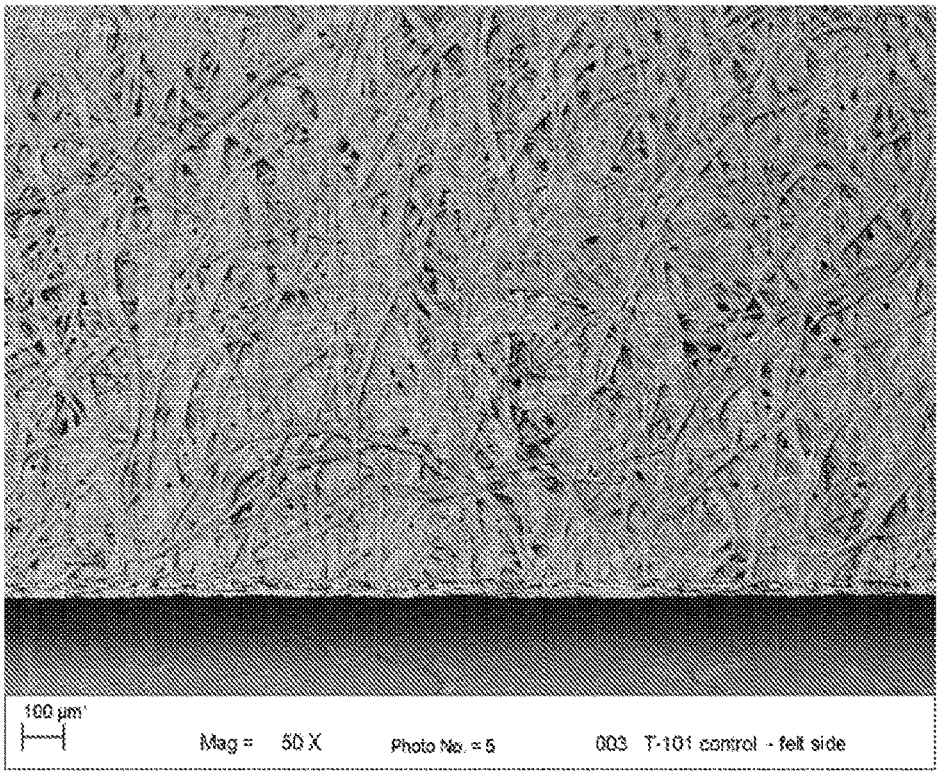
FIGS. 6A and 6B shown magnified (50×) pictures showing, in FIG. 6A, the top surface of an untreated fibrous substrate and, in FIG. 6B, the top surface of a paper product in which the top layer of the paper product comprises a plurality of highly fibrillated surface enhanced pulp fibers that are integrally bonded to an underlying fibrous substrate.
Figure 6B:
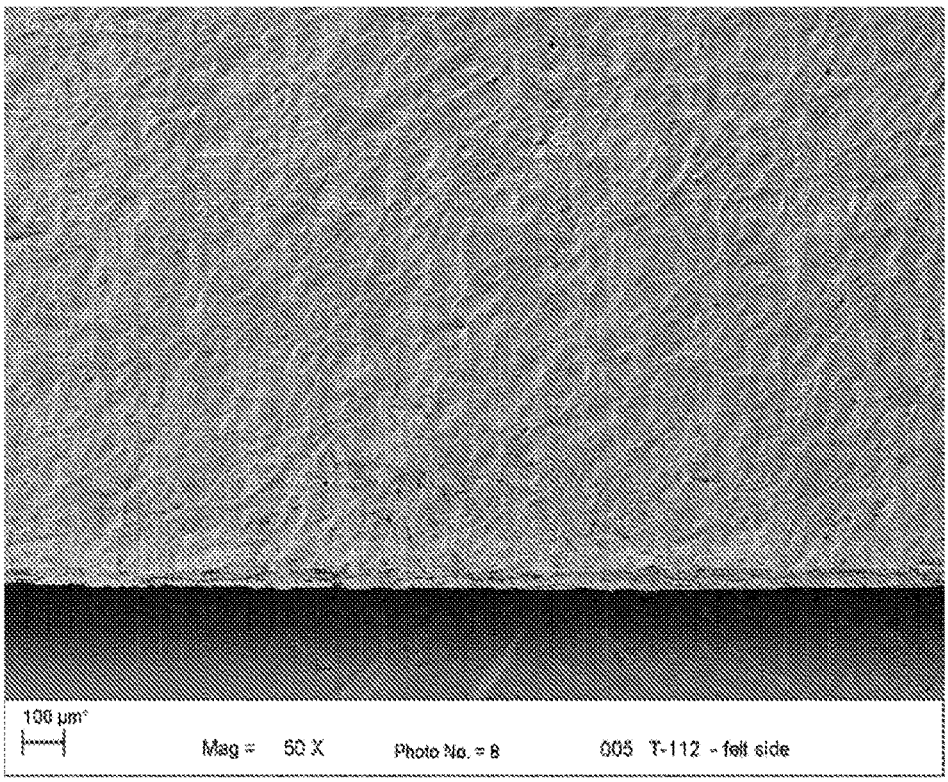
Figure 7B:
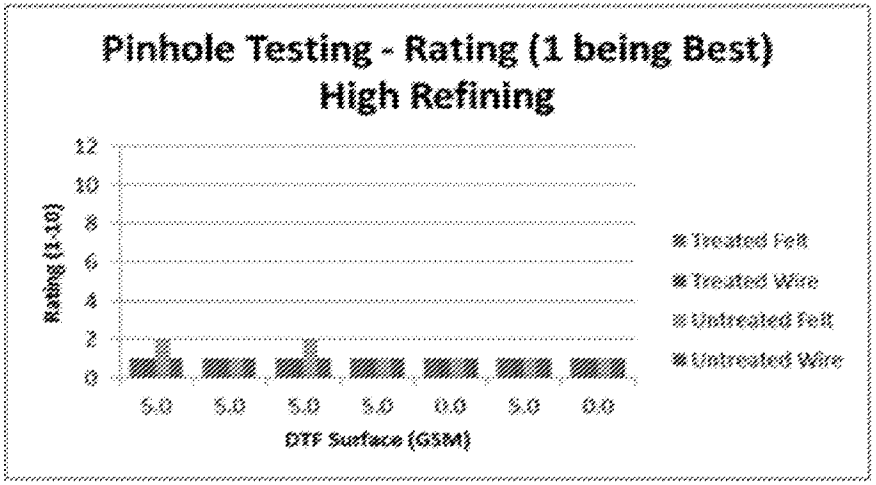
FIGS. 7A and 7B graphically illustrate the results of the pinhole testing for low refined pulp (FIG. 7A) and high refined pulp (FIG. 7B). As used herein the high refined pulp is refined to a higher energy input as compared to the low refined pulp. For example and without limitation, the high refined pulp can be refined at about twice the energy of the low refined pulp.
Figure 7A:
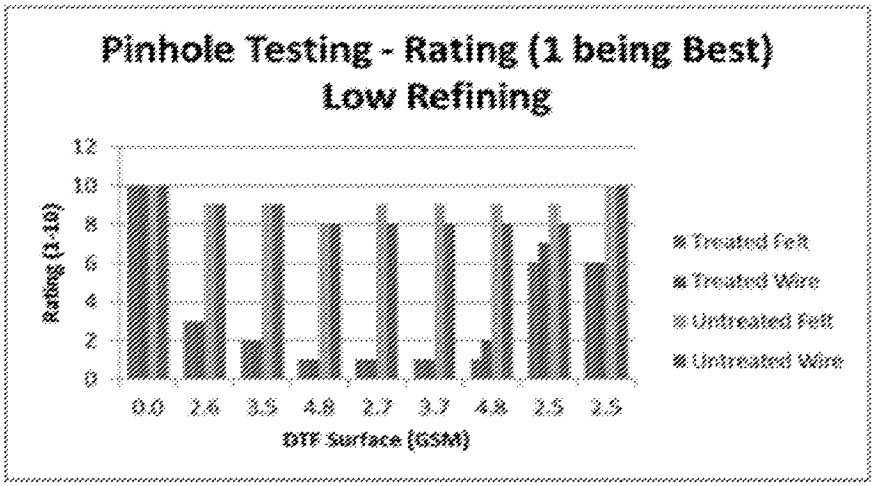

Additionally, the test results showed, when compared to an untreated test paper product, as shown in FIG. 6A, that the treated paper product, as shown in FIG. 6B, markedly reduced the number of pinholes in the formed paper product. Similarly, FIGS. 7A and 7*b* graphically illustrate the pinhole testing for low refined pulp (FIG. 7A) and high refined pulp (FIG. 7B) used for surface treatment. As used herein, pinholes refers to small holes in the paper that are created during the papermaking process. Conventionally, pinholes are typically detected in the sheet by holding the sheet up to a light source. This procedure provides a quantitative way of measuring pinholes in a given area. The pinhole test methodology comprises providing: a paper sample that is free of creases or defects; a blank, coated paper for backing (1 per test); a test ink, such as K & N test ink, which is stirred prior to use; a balance, and a 5.75 kg weight. In operation, the pinhole test methodology is initiated, the paper sample is tared on the balance. Subsequently, 1.5-2.0 grams of test ink is placed on the paper sample. The test sample with ink is then moved onto the coated paper and the sample and ink are covered with a second sheet of paper. Next, the weight is centered and placed over the ink and a time is set of two minutes. After the time has elapsed, the weight is removed and the sample is lifted away from the backing paper. Finally, the backing paper is examined for any grey spots from the ink, which will indicate where there are pinholes in the sheet.

It should be emphasized that the above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or Steps are intended to be supported by the present disclosure. Moreover, although specific terms are employed herein, as well as in the claims which follow, they are used only in a generic and descriptive sense, and not for the purposes of limiting the described invention, nor the claims which follow.

What is claimed is:

1. A method of making a paper product having improved printed characteristics, comprising the steps of:

depositing an aqueous slurry comprising a blend of cellulosic fibers and water onto a wire moving in a machine direction;

at least partially dewatering the aqueous slurry of cellulosic fibers and water to form a fibrous substrate;

applying a surface treatment to a top surface of the fibrous substrate to form a treated fibrous substrate, wherein:

the surface treatment comprises an aqueous composition that comprises hardwood pulp fibers and water;

the hardwood pulp fibers have a length weighted average fiber length of at least 0.19 millimeters (mm) and an average hydrodynamic specific surface area of at least 10 square meters per gram ($m^2/g$); and the hardwood pulp fibers have a concentration of 0.5 to 7.5 percent in the aqueous composition; and drying the treated fibrous substrate to form a paper product, wherein a basis weight of the hardwood pulp fibers in the formed paper product is between 1 and 20 gsm.

2. The method of claim 1, wherein the hardwood pulp fibers are applied to the top surface of the fibrous substrate in the aqueous composition at a consistency of between 0.5 to 1.5 percent.

3. The method of claim 1, wherein the basis weight of the hardwood pulp fibers in the formed paper product is between 3 to 5 gsm.

4. The method of claim 1, wherein a weight of the hardwood pulp fibers in the formed paper product is between 2 to 15 percent of a weight of the fibrous substrate in the formed paper product.

5. The method of claim 1, wherein a weight of the hardwood pulp fibers in the formed paper product is between 2 to 20 percent of a weight of the fibrous substrate in the formed paper product.

6. The method of claim 1, wherein the surface treatment comprises at least one of: a starch composition; a pigmentation composition; and a surface coating formulation.

7. The method of claim 1, wherein: the depositing step is performed by the use of a first head box; and the applying step comprises dispersing a substantially uniform layer of the aqueous composition onto the top surface of the fibrous substrate by the use a second head box positioned downstream of the first head box.

8. The method of claim 1, wherein the applying step comprises dispersing a substantially uniform layer of the aqueous composition onto the top surface of the fibrous substrate by the use of at least one of: a two-roll size press; a rod-metering size press; a blade coater; a fountain coater; a cascade coater; and a spray applicator.

9. The method of claim 1, wherein: the hardwood pulp fibers are a first plurality of hardwood pulp fibers; and the blend of cellulosic fibers comprises a second plurality of hardwood pulp fibers forming between 2% to 20%, by weight, of the fibrous substrate, the second plurality of hardwood pulp fibers having a length weighted average fiber length of at least 0.20 mm and an average hydrodynamic specific surface area of at least 10 $m^2/g$.

10. The method of claim 1, wherein the aqueous composition comprises starch and between 0.2% to 5.0%, by weight, of the aqueous composition is the hardwood pulp fibers.

11. The method of claim 10, wherein the aqueous composition has a viscosity of 10 to 220 centipoise.

12. The method of claim 1, wherein, prior to the applying step, the hardwood pulp fibers are chemically reacted with a composition configured to enhance ink jet printing characteristics of the paper product.

13. The method of claim 1, wherein the hardwood pulp fibers are made by refining hardwood pulp with an energy input of between 400 to 1,800 kilowatt-hours/ton.

14. The method of claim 1, wherein the hardwood pulp fibers are made by refining hardwood pulp at a specific edge load of less than 0.2 Ws/m until an energy consumption of at least 450 kWh/ton is reached.

15. The method of claim 1, wherein the hardwood pulp fibers have a fiber count of at least 12,000 fibers per milligram on an oven-dry basis.

16. The method of claim 14, wherein the length weighted average length of the hardwood pulp fibers is at least 60% of the original length weighted average length of the hardwood pulp fibers prior to the refining.

17. The method of claim 1, wherein the length weighted average fiber length of the hardwood pulp fibers is at least 0.4 mm and the average hydrodynamic specific surface area of the hardwood pulp fibers is at least about 12 $m^2/g$.

18. The method of claim 14, wherein the average hydrodynamic specific surface area of the hardwood pulp fibers is at least 4 times greater than the average specific surface area of the hardwood pulp fibers prior to refining.

19. The method of claim 14, wherein the hardwood pulp is refined using a pair of ultrafine refiner plates that have a bar width of 1.0 millimeters or less and a groove width of 1.6 millimeters or less.

20. The method of claim 1, wherein a basis weight of the fibrous substrate in the formed paper product is between 30 and 75 gsm.

* * * * *